US011618605B2

(12) United States Patent
Carlson et al.

(10) Patent No.: US 11,618,605 B2
(45) Date of Patent: Apr. 4, 2023

(54) CRATE DIVIDER SYSTEM

(71) Applicant: Sidio Corp., San Dimas, CA (US)

(72) Inventors: Trevor Nicholas Carlson, Glendora, CA (US); Dale Jacob Pray, Glendora, CA (US)

(73) Assignee: Sidio Corp., San Dimas, CA (US)

( * ) Notice: Subject to any disclaimer, the term of this patent is extended or adjusted under 35 U.S.C. 154(b) by 0 days.

(21) Appl. No.: 17/524,433

(22) Filed: Nov. 11, 2021

(65) Prior Publication Data

US 2022/0219858 A1 Jul. 14, 2022

Related U.S. Application Data

(60) Provisional application No. 63/136,110, filed on Jan. 11, 2021.

(51) Int. Cl.
*B65D 1/24* (2006.01)
*B65D 25/06* (2006.01)

(52) U.S. Cl.
CPC ..... *B65D 1/243* (2013.01); *B65D 25/06* (2013.01); *B65D 2501/2435* (2013.01); *B65D 2501/24133* (2013.01); *B65D 2501/24222* (2013.01); *B65D 2501/24286* (2013.01)

(58) Field of Classification Search
CPC ..... B65D 1/243; B65D 25/06; B65D 2501/24133; B65D 2501/24222; B65D 2501/24286; B65D 2501/2435; B65D 25/02; B65D 2543/00194; B65D 2543/00296; B65D 2543/00666; B65D 2543/00694; B65D 2543/00722; B65D 2543/00805; B65D 21/0219; B65D 25/30
See application file for complete search history.

(56) References Cited

U.S. PATENT DOCUMENTS 3,954,202 A 5/1976 Petrick
2007/0002518 A1* 1/2007 Wilk ..... H01G 11/10 361/272
2007/0126326 A1 6/2007 O'Halloran et al.
(Continued)

OTHER PUBLICATIONS www.decked.com/products/drawer-dividers-full-size; Title: Decked Drawer Dividers to Organize Wide Decked System Drawers 4 Pack; Date: 101/20/2021.

*Primary Examiner* — Kareen K Thomas
(74) *Attorney, Agent, or Firm* — Eric Karich; Karich & Associates

(57) ABSTRACT

A crate divider system has a generally rectangular crate having a bottom surface with a pair of side walls, a front wall, and a rear wall meeting at corners and each extending upwardly from the bottom surface to an upper perimeter. The crate has a plurality of vertical ridges formed on each of the side walls, the plurality of vertical ridges defining a plurality of slots each having a width. A horizontal ridge is formed on each of the side walls and spaced a distance from the bottom surface of the crate. The system further has at least one divider sheet having an upper edge, a lower edge, and side edges, the at least one divider sheet further having a thickness that is less than the width of each of the slots such that the at least one divider sheet may be inserted into the slots. A locking mechanism of the at least one divider sheet is adapted to removably engage the horizontal ridges of the crate.

7 Claims, 4 Drawing Sheets

(56) References Cited

U.S. PATENT DOCUMENTS

| | | | | |
|---|---|---|---|---|
| 2018/0060623 | A1* | 3/2018 | Devine, Jr. | G06Q 10/087 |
| 2018/0148221 | A1* | 5/2018 | Hill | B65D 25/06 |
| 2018/0201404 | A1* | 7/2018 | Lam | B65D 5/4803 |
| 2018/0251263 | A1* | 9/2018 | Shamp | B65D 21/0233 |
| 2019/0107131 | A1* | 4/2019 | Davis | F16B 5/0032 |
| 2019/0112094 | A1* | 4/2019 | Dwork | B65D 5/0254 |
| 2019/0127113 | A1* | 5/2019 | Cooper | B65D 25/06 |
| 2019/0152677 | A1* | 5/2019 | Hoyt | B65D 81/3818 |
| 2019/0233177 | A1* | 8/2019 | Han | B65D 81/3818 |
| 2019/0241319 | A1* | 8/2019 | Drexler | B65D 25/06 |

* cited by examiner

CRATE DIVIDER SYSTEM

CROSS-REFERENCE TO RELATED APPLICATIONS

This application for a utility patent claims the benefit of U.S. Provisional Application No. 63/136,110, filed Jan. 11, 2021.

BACKGROUND OF THE INVENTION

Field of the Invention

This invention relates generally to crates, and more particularly to crate organizer systems.

Description of Related Art

Storage containers that include removably dividers are known in the art. For example, O'Halloran, U.S. 2007/0126326, teaches a storage compartment for a refrigerator that includes dividers that may be inserted into tracks and locked into place for dividing up the storage compartment.

There is a need in the art for a storage crate that includes dividers that are fast and easy to insert, remove, and move, so that different configurations may be readily achieved for a wide variety of uses. The faster and easier the adjustments may be made, the better.

SUMMARY OF THE INVENTION

The present invention teaches certain benefits in construction and use which give rise to the objectives described below.

The present invention provides a crate divider system comprising a generally rectangular crate having a bottom surface with a pair of side walls, a front wall, and a rear wall meeting at corners and each extending upwardly from the bottom surface to an upper perimeter. The crate has a plurality of vertical ridges formed on each of the side walls, the plurality of vertical ridges defining a plurality of slots each having a width. A horizontal ridge is formed on each of the side walls and spaced a distance from the bottom surface of the crate. The system further has at least one divider sheet having an upper edge, a lower edge, and side edges, the at least one divider sheet further having a thickness that is less than the width of each of the slots such that the at least one divider sheet may be inserted into the slots. A locking mechanism of the at least one divider sheet is adapted to removably engage the horizontal ridges of the crate.

A primary objective of the present invention is to provide a crate divider system having advantages not taught by the prior art.

Another objective is to provide a crate divider system having at least one divider sheet for removable insertion into a crate.

A further objective is to provide a crate divider system that provides several different options for creating compartments within a crate for organization.

A further objective is to provide a crate divider system that includes dividers that are fast and easy to insert, remove, and move, so that different configurations may be readily achieved for a wide variety of uses.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention.

DETAILED DESCRIPTION OF THE INVENTION

The above-described drawing figures illustrate the invention, a crate divider system for organization and storage.

Figure 1:
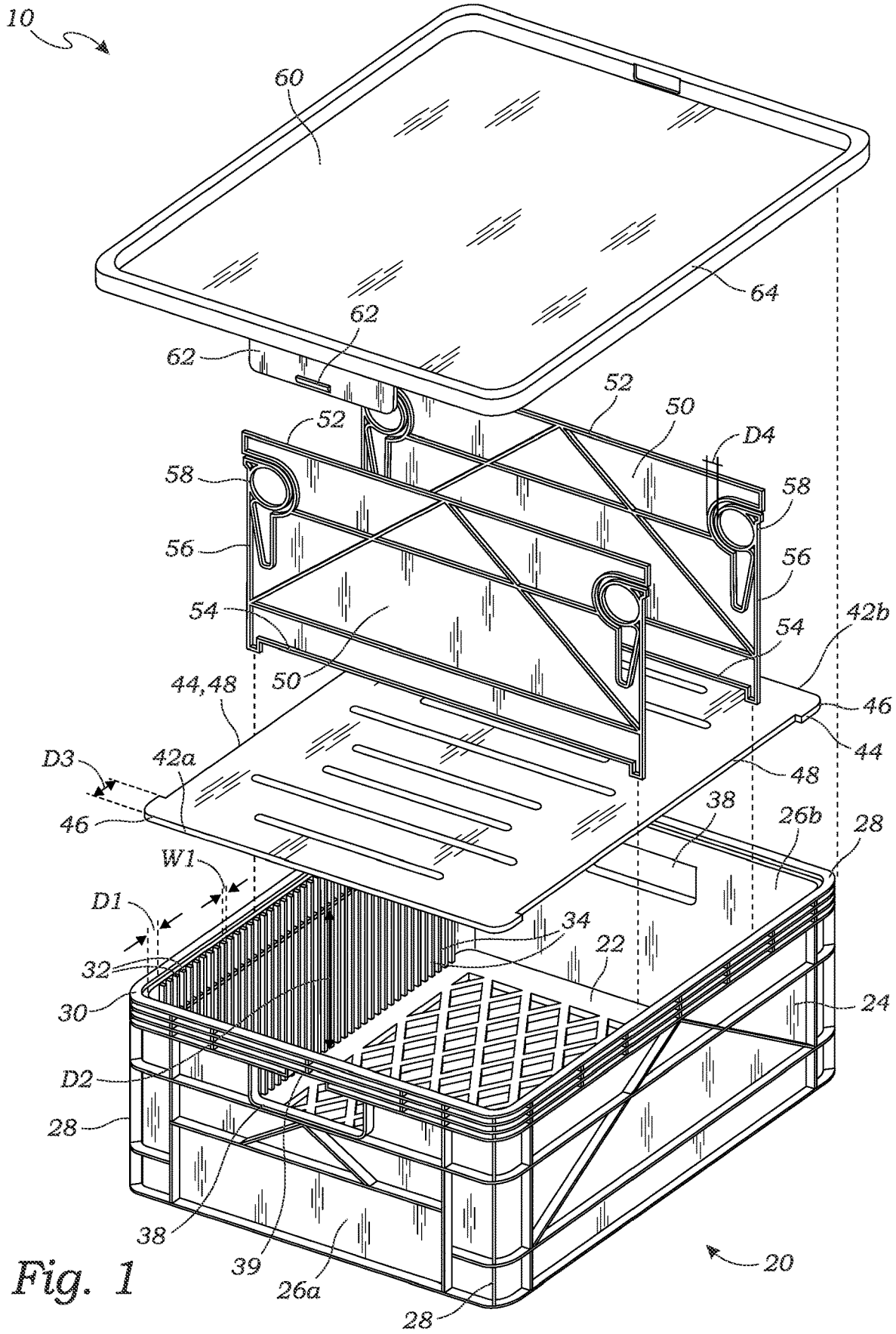
FIG. 1 is a perspective view of a crate divider system according to one embodiment of the present invention.

FIG. 1 is an exploded perspective view of a crate divider system 10 according to one embodiment of the present invention. As shown in FIG. 1, the crate divider system 10 comprises a generally rectangular crate 20 and at least one divider sheet 50, in this embodiment further comprising a bottom sheet 40 and a top lid 60, each discussed in detail below. The crate 20 includes a bottom surface 22 with a pair of side walls 24, a front wall 26*a*, and a rear wall 26*b* meeting at corners 28 and each extending upwardly from the bottom surface 22 to an upper perimeter 30. A plurality of vertical ridges 32 (in this embodiment, forty-three ridges, but there may be any desired number of ridges) are formed on the side walls 24 of the crate 20, the plurality of vertical ridges 32 defining a plurality of slots 34 each having a width W1 adapted for receiving at least one divider, discussed further below. In this embodiment, the plurality of vertical ridges 32 is further spaced a distance D1 from the corners 28 of the crate 20, and a horizontal ridge 36 is formed on each of the side walls 24 and spaced a distance D2 from the bottom surface 22 of the crate 20.

In this embodiment, the crate 20 additionally comprises handle apertures 38 formed within the front and rear walls 26 and sized to receive a person's hands for carrying the crate 20, the handle apertures 38 further being adapted to receive a flange 62 of the top lid 60, the top lid 60 being discussed in further detail below. As shown in FIG. 1, in various embodiments, the crate 20 may include further features such as reinforcement ribs, ornamental structures, etc., according to the needs of the manufacturer. In some implementations of the present invention, the crate 20 is constructed of polypropylene, but in other embodiments, any suitable material may be used (e.g., HDPE and other polymers, ABS, vinyl, etc.).

As illustrated, the bottom sheet 40 is sized to fit on the bottom surface 22 of the crate 20 and comprises a top edge 42*a*, a bottom edge 42*b*, and side edges 44 meeting at corners 46, wherein the side edges 44 each have an indented portion 48. When the bottom sheet 40 is within the crate 20, the corners 46 of the bottom sheet 40 sit adjacent the corners 28 of the crate 20, and a distance D3 that is approximately equal to D1 denotes the beginning of the indented portion 48 on the side edges 44. The indented portion 48 is sized to allow the vertical ridges 32, which protrude from the side walls 24 of the crate 20, while the bottom sheet 40 is still flush with the corners 28 of the crate 20.

As shown in FIG. 1, the at least one divider sheet 50 is in the form of a planar sheet having an upper edge 52, a lower edge 54, and side edges 56, the at least one divider sheet 50 further having a thickness that is less than the width W1 of each of the slots 34 such that the at least one divider sheet 50 may be inserted into the slots 34. In some embodiments, the side edges of each divider may extend past the lower edge 54 a length that is approximately equal to the thickness of the bottom sheet 40 such that the side edges 56 may slide between the indented portions 48 of the bottom sheet 40 and the side walls 24 of the crate 20. A locking mechanism 58 of the at least one divider sheet 50 is adapted to removably engage the horizontal ridges 36 of the crate 20, the locking mechanism 58 being best shown in FIGS. 2-3 and discussed at length below. In this embodiment, the dividers are constructed of ribbed ABS, but in other embodiments may be any suitable material known in the art.

As illustrated, the top lid 60 is sized and adapted to fit over the perimeter 30 of the crate 20 and may include the flange 62 adapted to fit into the handle apertures 38 of the crate 20. The top lid 60 may snap over the apertures 38 and/or perimeter 30, or it may be held by friction, or another means. In this embodiment, the flange 62 includes a tab 62 that may frictionally engage a notch 39 in each handle aperture, or this feature may not be included. The top lid 60 may further have a perimeter 64 that is raised above the rest of the top lid 60, which may be sized to receive the bottom of another crate 20 such that multiples of the crate 20 are stackable.

Figure 2:
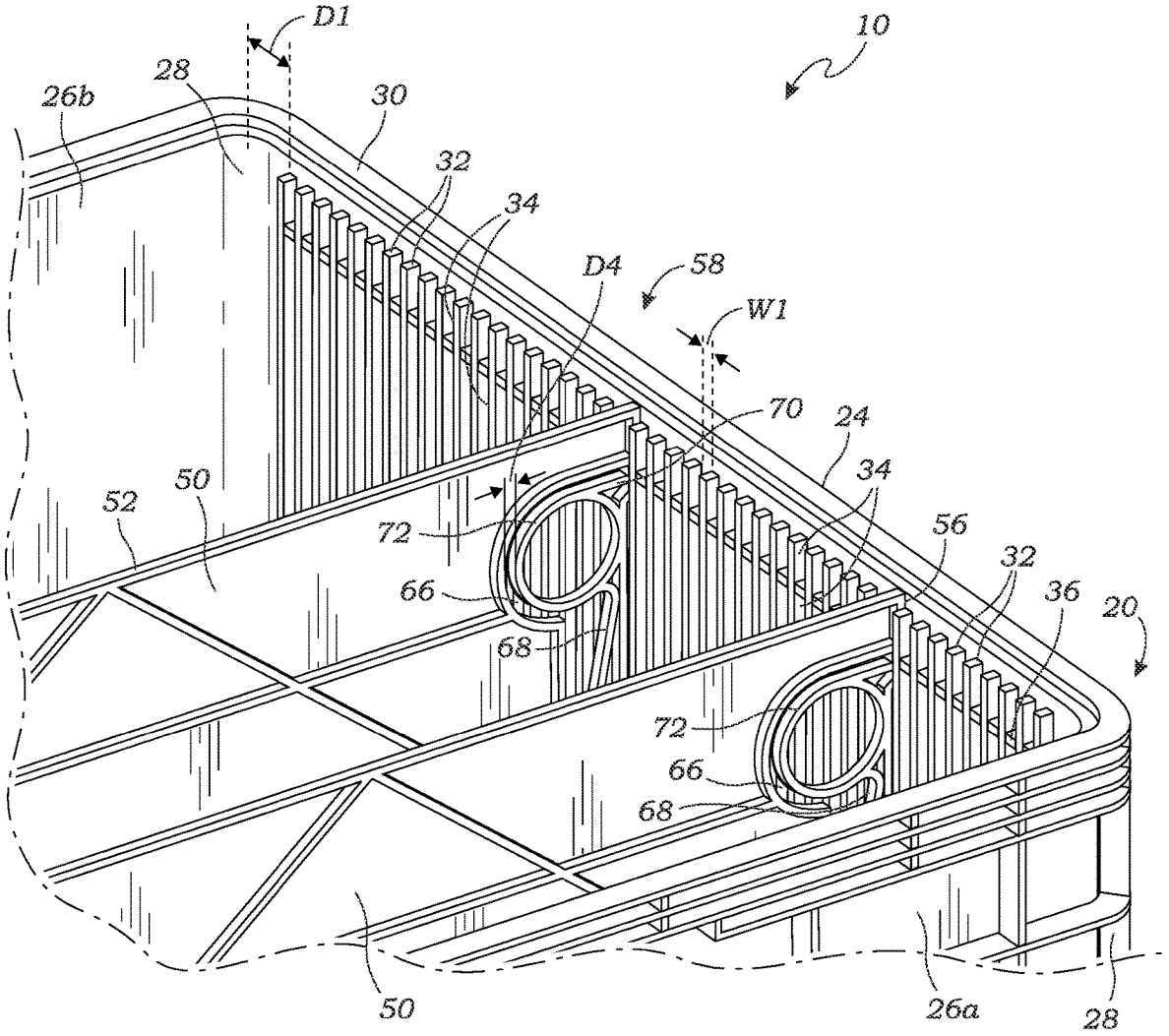
FIG. 2 is a side elevational view thereof.
Figure 3:
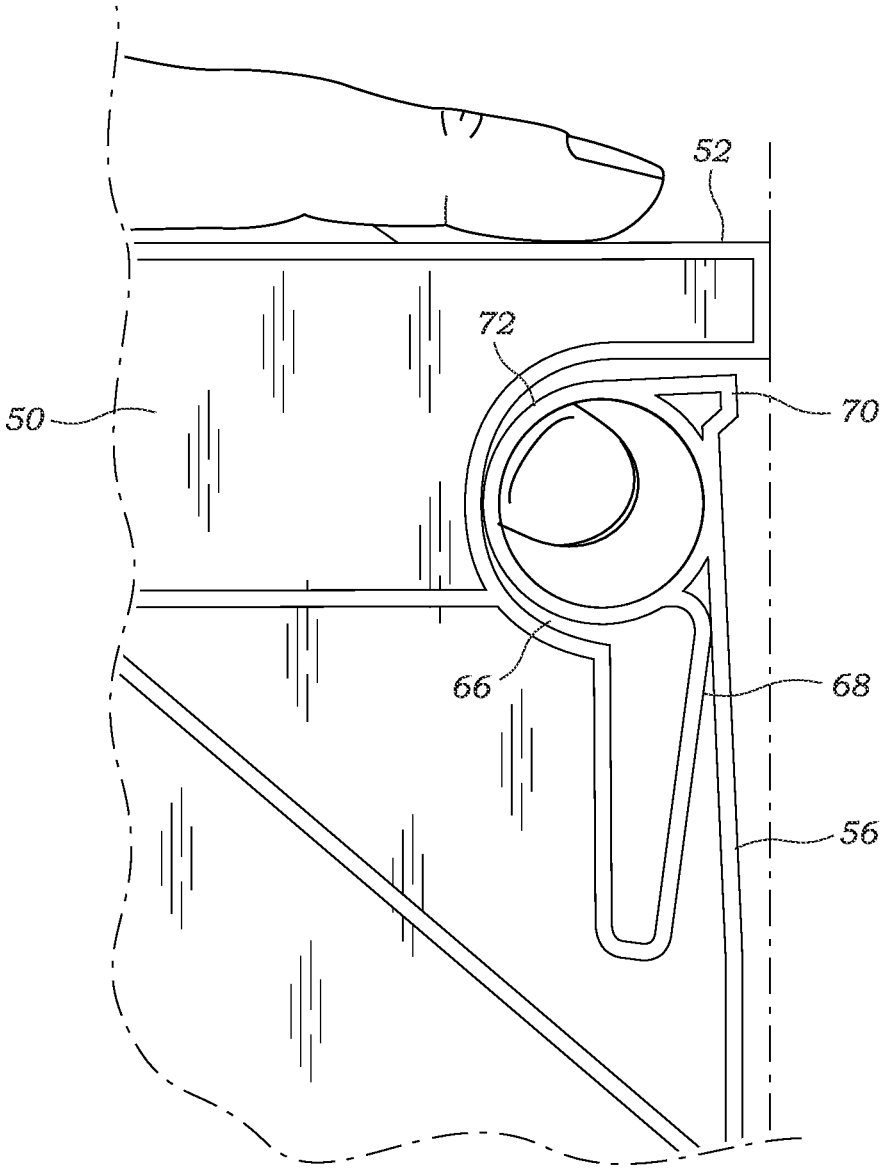
FIG. 3 is a plan view thereof.

FIG. 2 is an up-close perspective view of the locking mechanism 58 engaged with the horizontal ridge 36 of the crate 20, and FIG. 3 is an up-close elevational view of the locking mechanism 58 of the crate divider system 10 being operated by a human hand. As shown in FIGS. 1-3, in this embodiment, each locking mechanism 58 comprises a recessed cutout 66 within the planar sheet 50 adjacent the side edge, and a resilient elongate arm 68 that extends upwardly from the side edge into the recessed cutout 66 to a locking protrusion 70, wherein the locking protrusion 70 extends laterally beyond the side edge. The locking mechanism 58 further includes a finger loop 72 on the resilient elongate arm 68 for pulling the locking protrusion 70 inwardly into the recessed cutout 66 (FIG. 3).

As shown in FIG. 2, the recessed cutout 66 is spaced a distance D4 from the finger loop 72, such that the finger loop 72 fits within the recessed cutout 66 and may move inwardly when pressure is applied, but biases back to the distance D4 when released. The locking protrusion 70 extends from the side edge a distance that is equal to or less than D4. Further, the side edge of the divider downwardly extends a distance from the locking protrusion 70 that is less than D2 of the crate 20, such that the locking protrusion 70 is released beneath the horizontal ridge 36 in a constructed configuration. As discussed above, the dividers are each in the form of a planar sheet having a thickness that is approximately equal to or less than the width W1 of the slots 34 of the crate 20, whereby the dividers can slide into the slots 34 and be held in place by the vertical ridges 32, and the locking mechanism 58 further engages the horizontal ridge 36 to further removably secure the divider sheet 50 in place.

Each component of the crate with divider system 10 may be fully separable. In use, a user may slide the bottom sheet 40 into the crate 20 with the indented portions 48 aligning with the vertical ridges 32, followed by any desired number of dividers inserted into the slots 34 of the crate 20. As shown in FIG. 3, the user may apply inward pressure to the finger loops 72 of the dividers 50 to draw back the locking protrusion 70, and release when the locking protrusion 70 can lock beneath the horizontal ridge 36. The user may perform the same process to remove the dividers. Finally, if desired, the user may fit the top lid 60 over the dividers and secure around the handle apertures 38 of the crate 20. In this configuration, the user may further wish to stack crates 20 on the top lid 60 for storage or organizational purposes.

Figure 4:
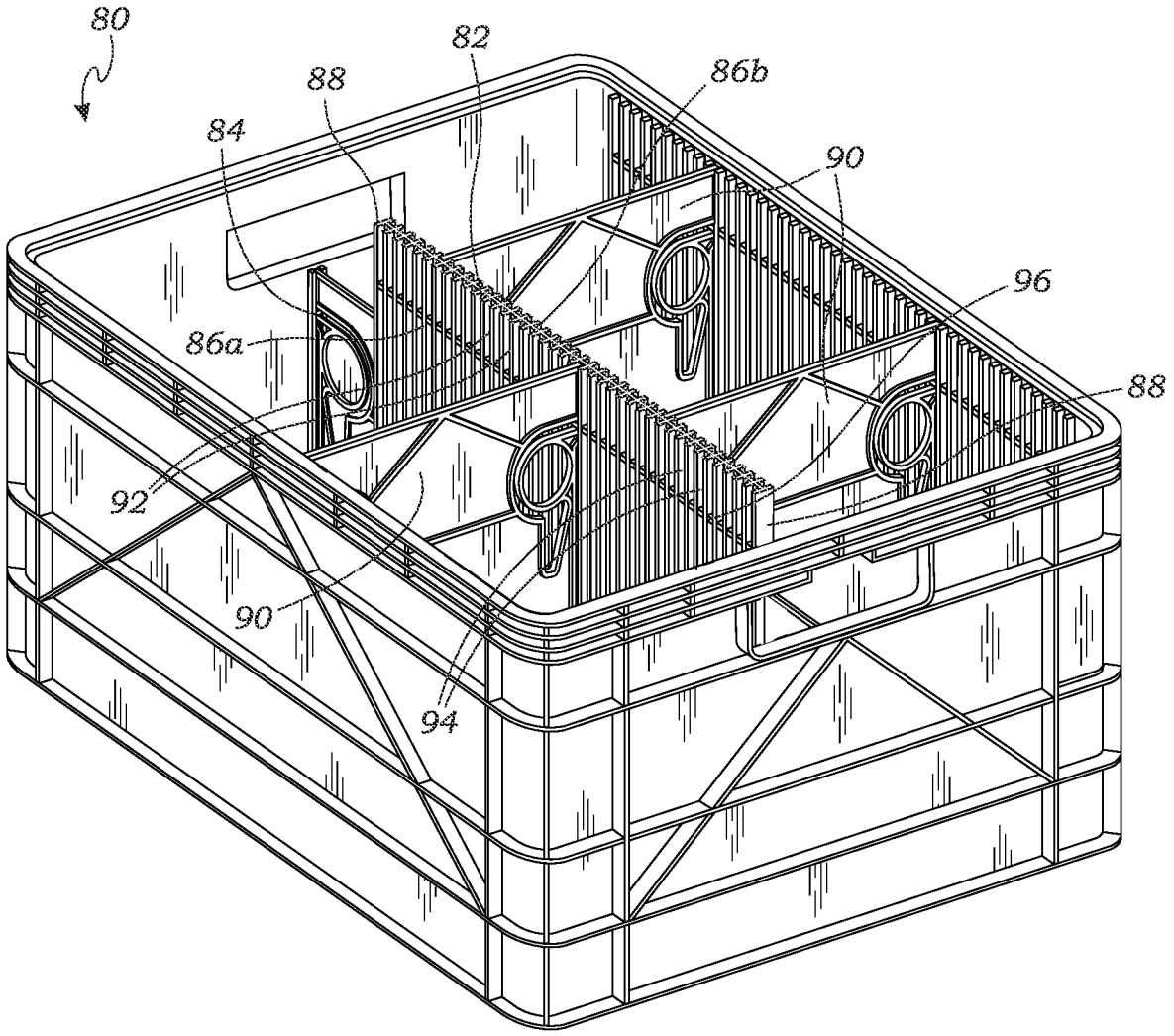
FIG. 4 is a perspective view of an alternative embodiment of the crate divider system.

FIG. 4 is a perspective view of an alternative embodiment 80 of the crate divider system. As shown in FIG. 4, in this embodiment, the at least one divider is in the form of a longitudinal divider 82 and a plurality of lateral dividers 90. The longitudinal divider 82 is adapted to extend between the front and rear walls 26*a* and 26*b* (shown in FIG. 1) of the crate 20, wherein the front and rear walls 26 each include at least one receiving channel 84 for receiving the longitudinal divider 82. While a single channel 84 is shown herein, any number of such channels may be used, in any configuration that is deemed desirable.

The longitudinal divider 82 of this embodiment further comprises a first face 86*a*, a second face 86*b*, and ends 88, wherein the first and second faces 86 each include a plurality of vertical ridges 92 forming slots 94 and a horizontal ridge 96 similar to those formed on the side walls 24 of the crate 20. The ends 88 of the longitudinal divider 82 each include the locking mechanism 58 described above, wherein each locking protrusion 70 removably engages a protrusion (not shown) of each receiving channel 84.

The plurality of lateral dividers 90 is structurally almost identical to the dividers 50 of FIGS. 1-3, except having a lateral width between the side edges that is lesser such the lateral divider slides into one of the slots 34 and 94 of both the crate 20 and the longitudinal divider 82, and removably engages the horizontal ridge 36 of the crate 20 with one locking mechanism 58, and the horizontal ridge 96 of the longitudinal divider with the other. Any desired number of lateral dividers 90 may be used for this embodiment, according to the organizational needs of the user.

The title of the present application, and the claims presented, do not limit what may be claimed in the future, based upon and supported by the present application. Furthermore, any features shown in any of the drawings may be combined with any features from any other drawings to form an invention which may be claimed.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A crate divider system comprising:

a rectangular crate having a bottom surface with a pair of side walls, a front wall, and a rear wall meeting at corners and each extending upwardly from the bottom surface to an upper perimeter;

a plurality of vertical ridges formed on each of the side walls of the crate, the plurality of vertical ridges defining a plurality of slots each having a width;

a horizontal ridge formed on each of the side walls and spaced a distance from the bottom surface of the crate;

at least one divider sheet having an upper edge, a lower edge, and side edges, the at least one divider sheet further having a thickness that is less than the width of each of the slots such that the at least one divider sheet may be inserted into the slots; and a locking mechanism of the at least one divider sheet adapted to removably engage the horizontal ridges of the crate.

2. A crate divider system comprising:

a rectangular crate having a bottom surface with a pair of side walls, a front wall, and a rear wall meeting at corners and each extending upwardly from the bottom surface to an upper perimeter;

a plurality of vertical ridges formed on each of the side walls of the crate, the plurality of vertical ridges defining a plurality of slots each having a width;

a horizontal ridge formed on each of the side walls and spaced a distance from the bottom surface of the crate;

a bottom sheet sized to fit on the bottom surface of the crate and having a top edge, a bottom edge, and side edges meeting at corners, wherein the side edges each have an indented portion for allowing the plurality of vertical ridges when the bottom sheet is within the crate;

at least one divider sheet having an upper edge, a lower edge, and side edges, the at least one divider sheet further having a thickness that is less than the width of each of the slots such that the at least one divider sheet may be inserted into the slots; and a locking mechanism of the at least one divider sheet adapted to removably engage the horizontal ridges of the crate.

3. The crate divider system of claim 2, further comprising a top lid is sized and adapted to fit over the perimeter of the crate.

4. The crate divider system of claim 2, further comprising handle apertures formed in the front and rear walls of the crate.

5. The crate divider system of claim 2, wherein the plurality of vertical ridges are spaced a distance from the corners of the crate.

6. The crate divider system of claim 2, wherein the side edges of each divider sheet may extend past the lower edge a length that is approximately equal to the thickness of the bottom sheet, such that the side edges may slide between the indented portions of the bottom sheet and the side walls of the crate.

7. The crate divider system of claim 2, wherein each locking mechanism comprises:

a recessed cutout within the planar sheet adjacent the side edge;

a resilient elongate arm that extends upwardly from the side edge into the recessed cutout to a locking protrusion, wherein the locking protrusion extends laterally beyond the side edge; and a finger loop on the resilient elongate arm for pulling the locking protrusion inwardly into the recessed cutout.

* * * * *